US010394173B2

(12) United States Patent
Yamamoto

(10) Patent No.: US 10,394,173 B2
(45) Date of Patent: Aug. 27, 2019

(54) IMAGE FORMING APPARATUS

(71) Applicant: CANON KABUSHIKI KAISHA, Tokyo (JP)

(72) Inventor: Tetsuya Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/495,748

(22) Filed: Apr. 24, 2017

(65) Prior Publication Data

US 2017/0315483 A1 Nov. 2, 2017

(30) Foreign Application Priority Data

Apr. 28, 2016 (JP) ..... 2016-091443

(51) Int. Cl.
*G03G 15/00* (2006.01)
*G03G 15/20* (2006.01)

(52) U.S. Cl.
CPC ..... *G03G 15/5004* (2013.01); *G03G 15/2039* (2013.01); *G03G 15/80* (2013.01)

(58) Field of Classification Search
CPC ..... G03G 15/2039; G03G 15/50; G03G 15/5004; G03G 15/80
USPC ..... 399/38, 46, 67, 75, 88
See application file for complete search history.

(56) References Cited

U.S. PATENT DOCUMENTS

2008/0304850 A1* 12/2008 Groninger ..... B41J 29/393 399/88
2010/0104297 A1* 4/2010 Hata ..... G03G 15/5004 399/33
2011/0229180 A1* 9/2011 Saito ..... G03G 15/5004 399/69

FOREIGN PATENT DOCUMENTS

JP H06-253454 A 9/1994
JP H07-319317 A 12/1995
JP 2007-65599 A 3/2007
JP 2015-99180 A 5/2015

* cited by examiner

*Primary Examiner* — Benjamin R Schmitt
(74) *Attorney, Agent, or Firm* — Canon U.S.A., Inc. IP Division

(57) ABSTRACT

The present disclosure provides a high productivity image forming apparatus in which a control unit calculates power to be used in the apparatus in a case where a throughput thereof is increased and compares the power to be used and suppliable power to the apparatus to determine whether the throughput is to be increased or not.

12 Claims, 10 Drawing Sheets

IMAGE FORMING APPARATUS

BACKGROUND

Field of Art

The present disclosure relates to an image forming apparatus, such as electrophotographic copiers and printers, having a fixing unit configured to heat and fix an unfixed toner image formed on a recording material to the recording material.

Description of the Related Art

Image forming apparatuses in recent years operating at higher speeds tend to consume more power. A high-speed color laser printer in particular may have a higher number of motors which may consume more power as the operating speed increases. For that, such an increase in speed may easily increase the power consumption of the entire printer.

An image forming apparatus is designed for supplying power for fixing a toner image to a fixing unit in a load state with standard direct-current (DC) power supply voltage, in a standard environment, and within a standard apparatus. However, such a design have a reduced margin for a maximum amount of power (more correctly, a maximum amount of current) suppliable by a commercial power supply with an increased amount of power consumption due to the increased speed. As a result, sufficient power may not be supplied to the fixing unit in some conditions of an image forming apparatus, such as, when low voltage is input from a commercial power supply, and when a drive load consumes more power due to influences of the period of use and environment of the image forming apparatus.

Accordingly, reduction of an initial throughput (number of prints per unit time period) of printing has been proposed in a case where it is determined that the amount of electric current for a printer exceeds the maximum amount of electric current suppliable from a commercial power supply (Japanese Patent Laid-Open No. 2015-99180).

However, an image forming apparatus to be controlled to reduce its throughput because of insufficient power generally operates at a higher speed. Therefore, printing may often be performed continuously on many recording materials. Reducing the throughput for printing on many recording materials may increase the time period until all of designated recording materials are output.

SUMMARY

An aspect of the present disclosure provides an image forming apparatus producing possibly high productivity.

Another aspect of the present disclosure provides an image forming apparatus producing possibly high productivity under control for reducing its throughput when power is insufficient.

An aspect of the present disclosure provides an image forming apparatus including an image forming unit configured to form an image on a recording material, a fixing unit having a heater and configured to heat and fix the image formed on a recording material onto the recording material, and a control unit, wherein the control unit calculates power to be used in the apparatus in a case where a throughput thereof is increased and compares the power to be used and suppliable power to the apparatus to determine whether the throughput is to be increased or not.

Further features will become apparent from the following description of exemplary embodiments with reference to the attached drawings.

DESCRIPTION OF THE EMBODIMENTS

First Embodiment

Figure 1:
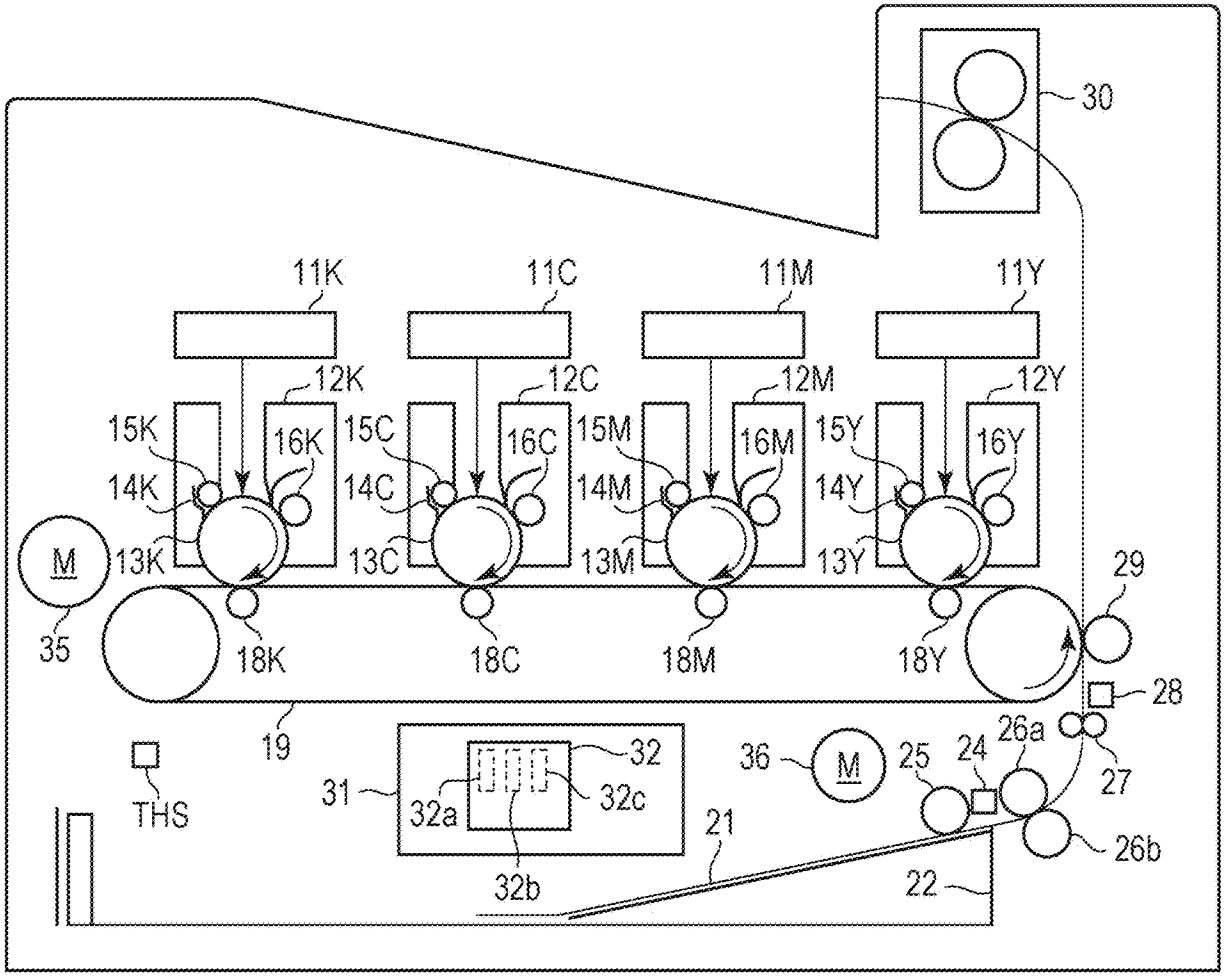
FIG. 1 is a cross-sectional view of an image forming apparatus.

A first embodiment will be described with reference to FIG. 1 to FIG. 4B. FIG. 1 is a configuration diagram of a tandem type color printer (image forming apparatus) applying an electrophotographic printing technology. The tandem type color printer is configured to output a full-color image by overlaying toner images of four colors of yellow (Y), magenta (M), cyan (C), and black (K).

For image formation in those colors, laser scanners (11Y, 11M, 11C, 11K) and cartridges (12Y, 12M, 12C, 12K) are provided. The cartridges (12Y, 12M, 12C, 12K) have photosensitive members (13Y, 13M, 13C, 13K) configured to rotate in directions indicated by arrows. The cartridges (12Y, 12M, 12C, 12K) have photosensitive member cleaners (14Y, 14M, 14C, 14K), charge rollers (15Y, 15M, 15C, 15K), and development rollers (16Y, 16M, 16C, 16K) placed in contact with the photosensitive members.

The four photosensitive members (13Y, 13M, 13C, 13K) are in contact with an intermediate transfer belt 19. Primary transfer rollers (18Y, 18M, 18C, 18K) are provided at positions opposing respective photosensitive members through the intermediate transfer belt 19.

A cassette 22 configured to store a recording material 21 has a presence/absence detecting sensor 24 configured to detect the presence or absence of the recording material 21. The recording material 21 is a material on which the image forming unit forms an image. A sheet feeding roller 25, separation rollers 26*a*, 26*b*, and a registration roller 27 are provided on a recording material conveyance path, and a registration sensor 28 is provided on a downstream side in a recording material conveying direction about the registration roller 27. A secondary transfer roller 29 and a fixing unit 30 are provided in contact with the intermediate transfer belt 19 on the downstream side in the recording material conveying direction.

A controller 31 is a control unit for the laser printer and includes one or more processors such as a CPU (central processing unit) 32 having a ROM 32*a*, a RAM 32*b*, a timer 32*c*, and so on and an input/output control circuit (not illustrated). FIG. 1 further illustrates an environment sensor THS.

Next, an image forming process will be described briefly. First, surfaces of the photosensitive members (13Y, 13M, 13C, 13K) are uniformly charged by the charge rollers (15Y, 15M, 15C, 15K). Next, the laser scanners (11Y, 11M, 11C, 11K) irradiate laser beams modulated based on image data to the surfaces of the photosensitive members (13Y, 13M, 13C, 13K) to form electrostatic latent images on the surfaces of the photosensitive members (13Y, 13M, 13C, 13K). The electrostatic latent images are developed by developing devices so that toner images in the colors are formed on the surfaces of the photosensitive members (13Y, 13M, 13C, 13K).

The toner images formed on the surfaces of the photosensitive members (13Y, 13M, 13C, 13K) are transferred onto the intermediate transfer belt 19 with primary transfer bias voltage applied from the primary transfer rollers (18Y, 18M, 18C, 18K). The photosensitive members (13Y, 13M, 13C, 13K), the development rollers (16Y, 16M, 16C, 16K), and the intermediate transfer belt 19 are all driven by a first motor 35. The first motor 35 is controlled in speed by the CPU 32.

The CPU 32 is configured to control image forming timing in the cartridges (12Y, 12M, 12C, 12K) in timing depending on the conveyance speed of the belt 19 and sequentially move the toner images on the intermediate transfer belt 19. Thus, a full-color image is formed on the intermediate transfer belt 19.

On the other hand, recording materials 21 within the cassette 22 is fed by the sheet feeding roller 25. Then, one recording material is separated from them by the separation rollers 26*a* and 26*b* and is conveyed to the secondary transfer roller 29 through the registration roller 27. After that, the toner images on the intermediate transfer belt 19 are transferred to the recording material 21 with bias voltage applied to the secondary transfer roller 29. The configuration including up to the secondary transfer roller 29 for transferring images to the recording material will be called an image forming unit. The recording material 21 having the toner images thereon is heated and is fixed by the fixing unit 30 and is then discharged from the printer. The image forming unit includes one or mare components for forming an image on a recording material 21 either directly or indirectly (i.e. via an intermediate transfer belt 19).

The rollers involved in the conveyance of a recording material, such as the sheet feeding roller 25, the registration roller 27, and the secondary transfer roller 29 are driven by a second motor 36. The second motor 36 is controlled in speed by the CPU 32.

Figure 2:
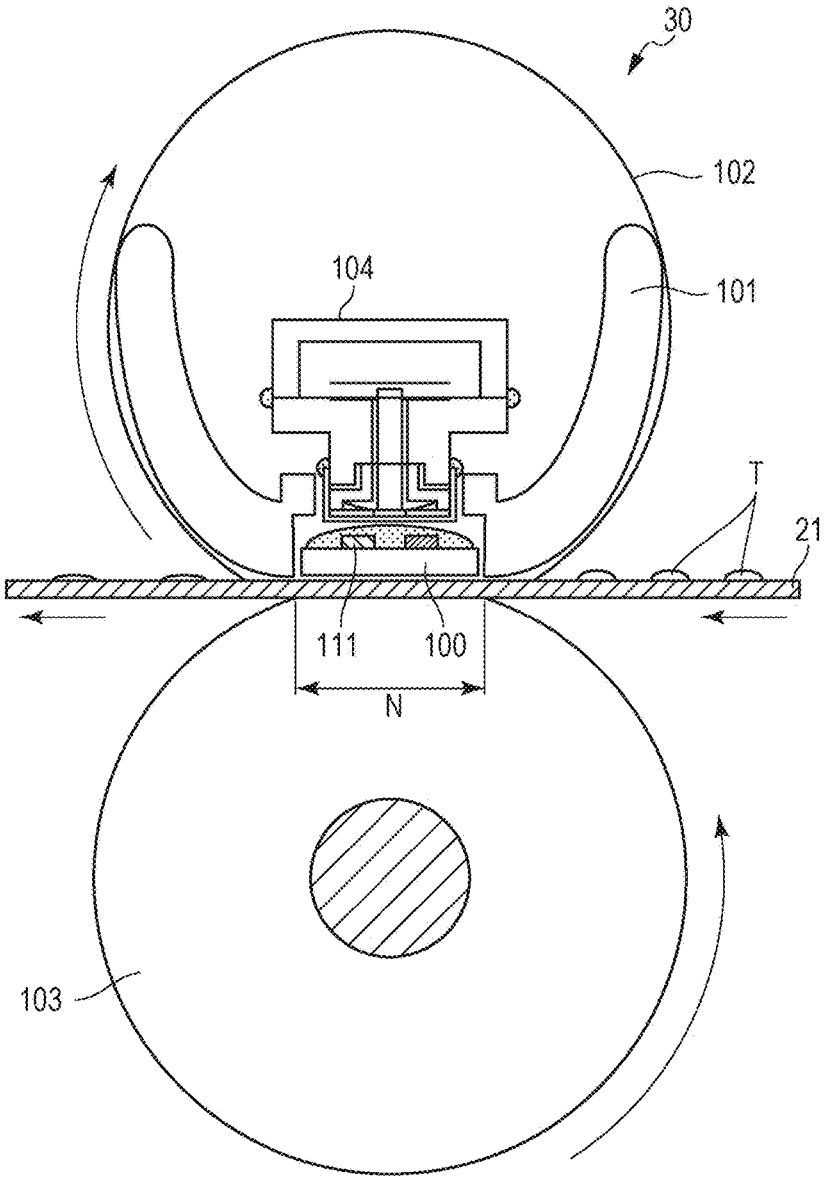
FIG. 2 is a cross-sectional view of a fixing unit.

Next, a configuration of the fixing unit 30 will be described with reference to FIG. 2. FIG. 2 is a cross-sectional view of the fixing unit 30. The fixing unit 30 is a fixing unit applying a film heating system using an endless film (tubular film). The fixing unit 30 has a fixing film 102, a heater 100 in contact with an inner surface of the fixing film 102, and a holder 101 configured to hold the heater 100. The heater 100 is a ceramic heater having a ceramic substrate on which a heat generating resistor 111 is printed, and power from a commercial power supply is supplied to the heat generating resistor 111. A pressure roller 103 and the heater 100 form a fixing nip N through the fixing film 102. The recording material 21 having a toner image T thereon is heated while it is being pinched and being conveyed at the fixing nip N. A safety element 104 is in contact with a back surface of the heater 100. When the temperature of the heater 100 rises abnormally, the safety element 104 is configured to operate such that the heat opens a feeder circuit to the heater 100 and may be a thermal switch according to this embodiment. A temperature detecting element (thermistor in this embodiment) 54 (as in FIG. 3) configured to detect a temperature of the heater 100 is provided on the back surface of the heater 100. The pressure roller 103 may be driven by a motor, not illustrated. The fixing film 102 is rotated by rotation of the pressure roller 103. The fixing unit is a device which consumes power and fixes an image that has been formed on a recording material to the recording material.

During fixing processing, the power to be supplied to the heater 100 is controlled such that the temperature detected by a temperature detecting element 54 can be kept at a control target temperature suitable for the toner fixing. The fixing unit may include a heater which consumes power, the heat supplied by the heater may be used for fixing the image to the recording material.

The fixing device using the fixing film 102 becomes ready for fixing in a short time period from start of power feeding to the heater 100 because the fixing film 102 has a low heat capacity. On the other hand, structures excluding the fixing film 102 have a higher heat capacity than that of the fixing film 102. For that, the fixing unit is not sufficiently heated when a continuous printing job is input for performing printing on a plurality of recording materials and when the first recording material 21 reaches the fixing nip N. Power to be supplied to the heater 100 includes power for fixing toner to a recording material and power for heating component structures of the fixing unit. Thus, a larger amount of power is to be used in the fixing unit for printing on the first recording material, and as the number of prints increases during the continuous printing processing, the amount of power decreases because the temperature of the fixing unit increases.

Next, with reference to FIG. 3, a configuration of a heater driving circuit unit will be described. The printer is connected to a commercial power supply 50. A switching power supply (hereinafter, called a power supply) 64 and the heater 100 (more correctly, heat generating resistor 111) are connected to the commercial power supply 50 through an alternating-current (AC) filter 51. The CPU 32 is configured to execute heater driving control and other controls in the printer and includes input/output ports, the ROM 32*a* and the RAM 32*b*. In an alternative embodiment, the power supply 64 is not a switching power supply and is instead another type of power supply which divides, alters, and/or transforms the power from the commercial power supply 50 and provides it to one or more components of the embodiment such as the load 65.

Figure 3:
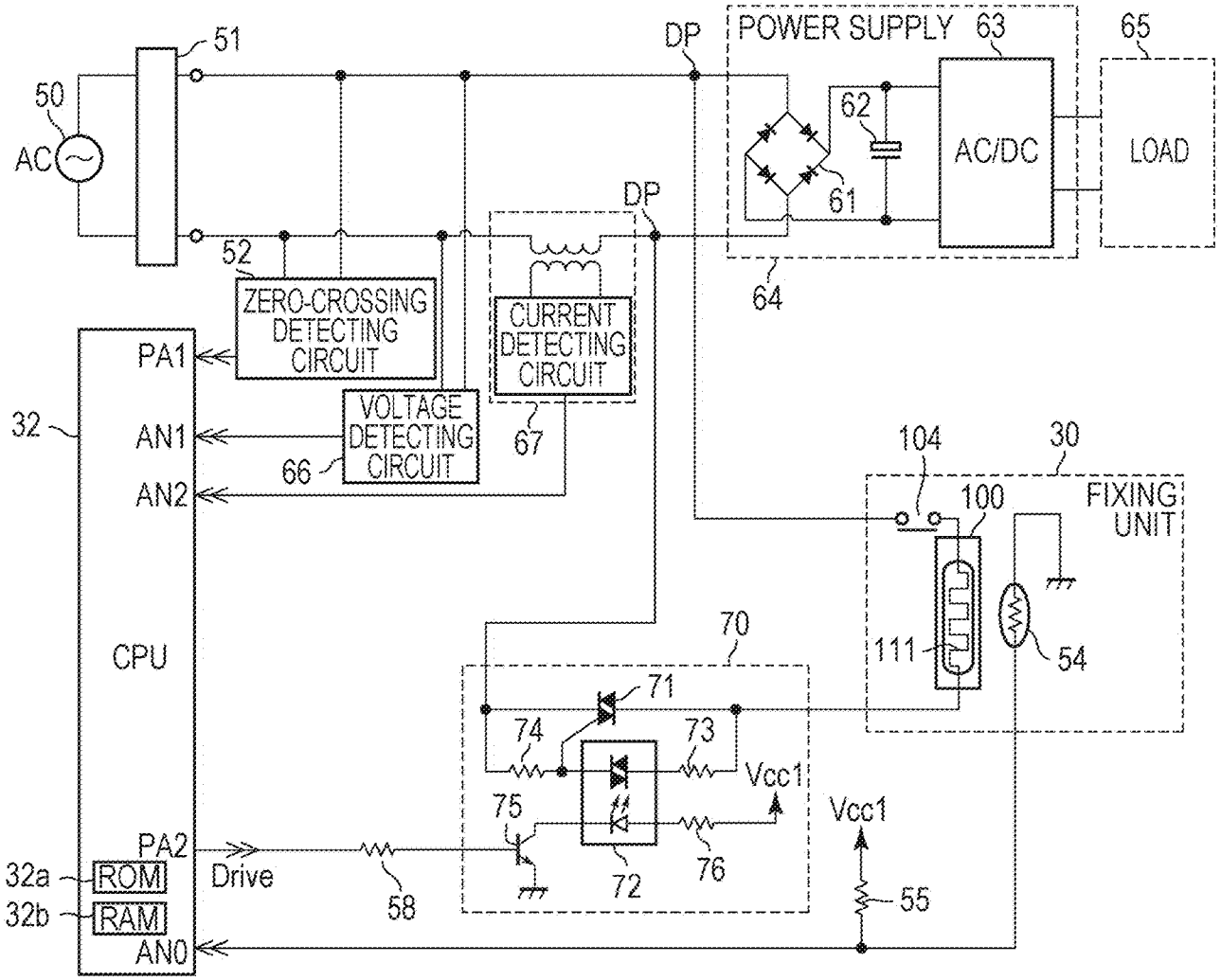
FIG. 3 is a circuit diagram according to a first embodiment.

FIG. 3 further illustrates a zero-crossing detecting circuit 52. The zero-crossing detecting circuit 52 is configured to reverse its output signal when voltage of the commercial power supply 50 is higher and is smaller than a threshold voltage (approximately 0 V). The circuit 52 is utilized for controlling the timing for heater driving. An output from the zero-crossing detecting circuit 52 is input to an input port PA1 of the CPU 32.

The temperature detecting element 54 has one terminal grounded and the other terminal connected to a fixed resistor 55. The CPU 32 has an analog input port AN0 configured to receive voltage acquired by dividing a voltage Vcc1 by resistance values of the temperature detecting element 54 and the fixed resistor 55. The temperature detecting element (thermistor) 54 has a characteristic that the resistance value decreases as the temperature increases. The CPU 32 is configured to convert the divided voltage input to the input port AN0 to a temperature on the basis of a preset voltage-temperature conversion table. Thus, the temperature of the heater 100 can be detected. The CPU 32 is configured to determine driving timing for a phase control circuit 70 on the basis of the detected temperature and output a Drive signal for driving a triac 71 through an output port PA2.

Next, the phase control circuit 70 will be described. The output port PA2 is changed to have a High level at a predetermined time so that the transistor 75 can be turned on through a base resistor 58. When the transistor 75 is turned on, a phototriac coupler 72 is thus turned on. The phototriac coupler 72 ensures isolation between primary and secondary electrical configurations. A resistor 76 is usable for controlling electric current to be fed to a light emitting diode within the phototriac coupler 72.

Resistors 73 and 74 are bias resistors for the triac 71, and the triac 71 is powered when the phototriac coupler 72 is turned on. The triac 71 is an element to be latched to a powered state until the potential difference across the triac 71 is equal to 0 V and no electric current remains when an ON trigger is applied to the triac 71 in a state that a potential difference across the triac 71 is caused by the commercial power supply 50. Thus, the amount of power corresponding to ON timing of the triac 71 is supplied to the heater 100. The CPU 32 performs phase control over ON timing of the commercial power supply 50 to control the power to be supplied to the heater 100.

On the other hand, the power supply 64 includes a diode bridge 61 and a smoothing capacitor 62 configured to rectify AC voltage and an AC-DC converter 63 configured to generate direct current (DC) voltage. DC voltage generated by the power supply 64 is supplied to a secondary side load 65 such as a control unit and a driving unit for the printer.

The AC filter 51 has a downstream line connected to a voltage detecting circuit 66. The voltage detecting circuit 66 outputs a voltage value corresponding to effective value voltage of the commercial power supply 50 to an output line isolated from the primary side by using a transformer. The CPU 32 receives a voltage value from the voltage detecting circuit 66 at the analog input port AN1 and detects the effective value of the voltage of the commercial power supply 50.

An electric-current detecting circuit 67 is provided on an upstream side from a branch point DP where a feeding line from the commercial power supply 50 branches to the power supply 64 and the phase control circuit 70. The electric-current detecting circuit 67 is configured to output a voltage value corresponding to an effective value of AC current to an output line isolated from the primary side by using a transformer. The CPU 32 receives a voltage value from the electric-current detecting circuit 67 at the analog input port AN2 so that a sum of values of electric current consumed by the load 65 and the heater 100 can be detected.

The CPU 32 is configured to calculate results of detections performed by the voltage detecting circuit 66 and the electric-current detecting circuit 67 to calculate a value of power to be consumed by the whole printer.

Figure 4A:
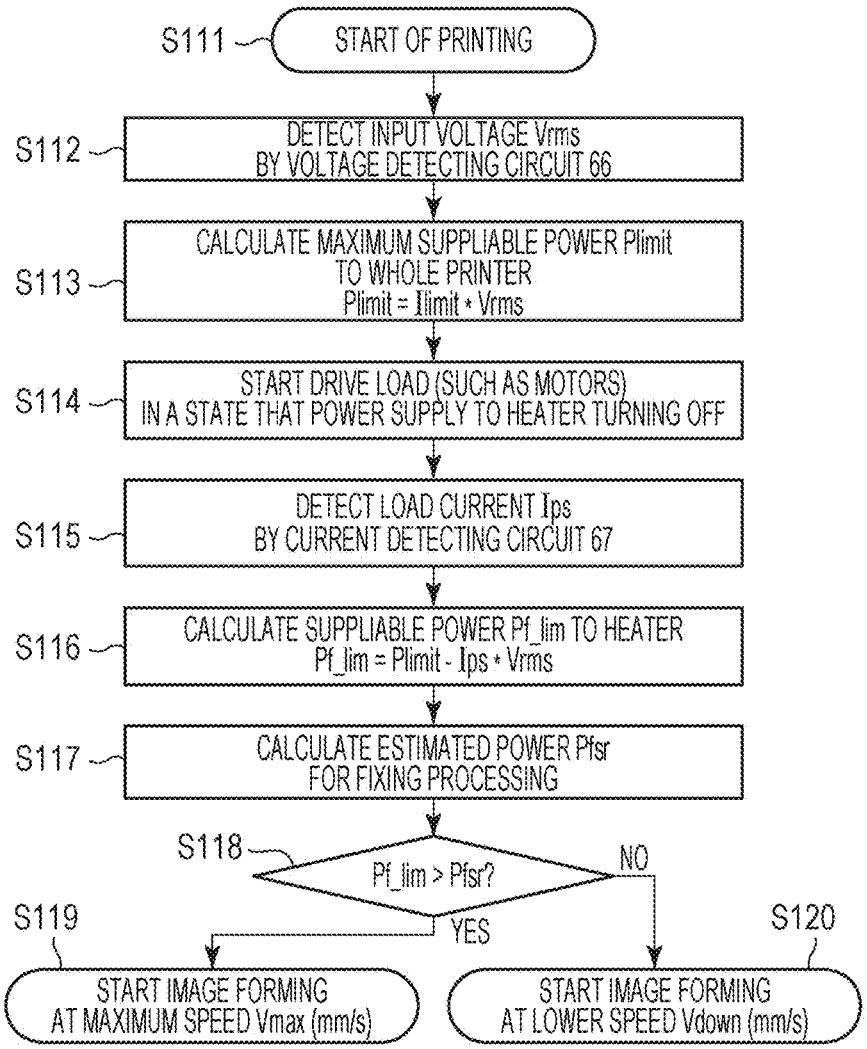
FIGS. 4A and 4B are flowcharts according to the first embodiment.
Figure 4B:
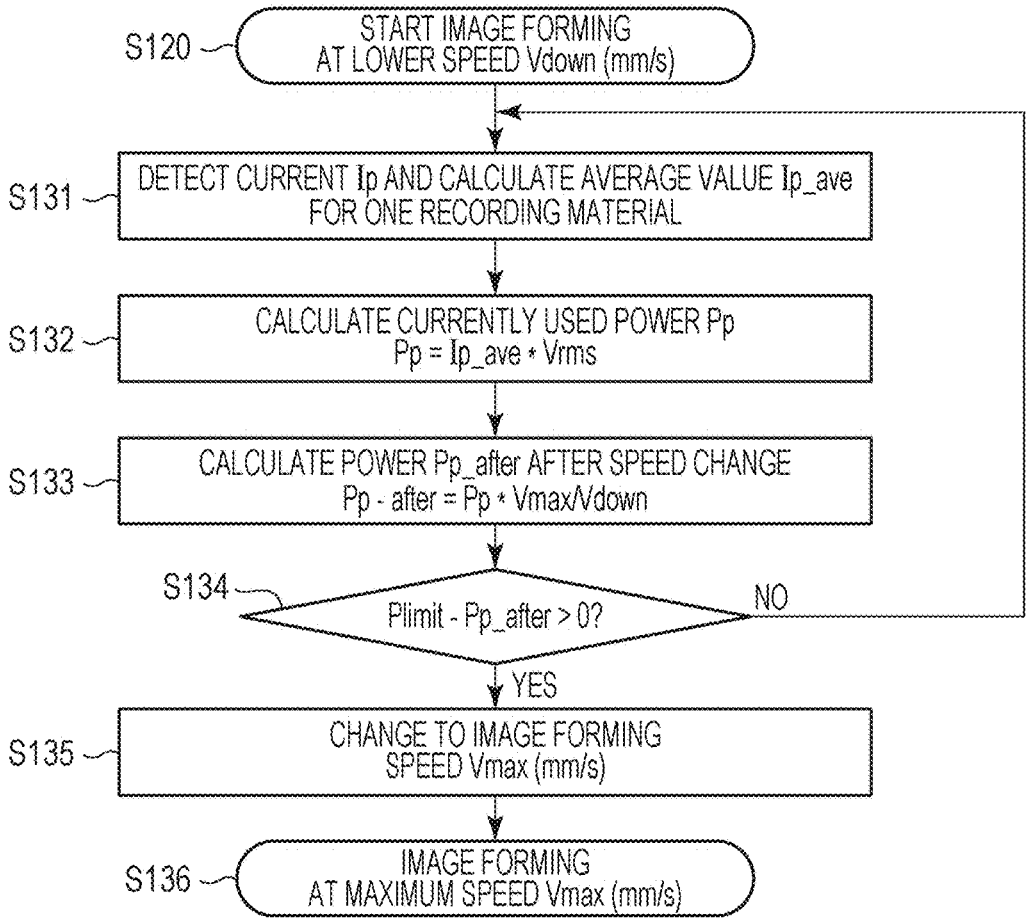

Next, controls to be performed in the image forming apparatus according to this embodiment will be described with reference to FIGS. 4A and 4B. The controls illustrated in flowcharts in FIGS. 4A and 4B are to be executed by the CPU 32 in accordance with programs prestored in the ROM 32*a*.

The CPU 32 in response to a print job (S111) detects an input voltage Vrms from the voltage detecting circuit 66 (S112). After that, on the basis of the detected Vrms, a maximum suppliable power Plimit that can be supplied to the entire printer (or the entire image forming apparatus) is calculated by the following expression (1) (S113).

$$Plimit = Ilimit * Vrms \quad (1)$$

Ilimit is an effective value (upper limit value) of electric current that is suppliable by the commercial power supply 50. For example, upper limit value Ilimit=12 Arms (Amps rms) and upper limit value Ilimit=10 Arms are prestored in the ROM 32*a* as initial set values for products in 100 V to 127 V regions and for products in 220 V to 240 V regions, respectively. The upper limit values Ilimit may be set by a user and may appropriately satisfy a requirements given by a user addressing a breaker which operates with 20 A or a user needing to limit the upper limit value to a lower value for some reason.

Next, for detection of a load current Ips of the power supply 64, all drive loads involved in image forming are driven in a state that power is not supplied to the heater 100 (S114), and the load current Ips in the state that power is not supplied to the heater 100 is detected by the electric-current detecting circuit 67 (S115). After that, power Pf_lim that can be supplied to the heater is calculated where the power Pf_lim is a difference value between a maximum suppliable power Plimit that can be supplied to the entire printer and a power Ips*Vrms to be consumed by the power supply load as in Expression (2) (S116).

$$Pf_lim = Plimit - Ips * Vrms \quad (2)$$

On the other hand, an estimated amount of power for the heater 100 for performing fix processing at the fixing nip N is calculated as an estimated required power Pfsr (S117). The value to be set for the estimated required power is increased as the environmental temperature decreases. Table 1 is a table of environmental temperatures and estimated required power and is stored in the ROM 32*a*. The estimated required power is calculated in accordance with the detected environmental temperature and with reference to Table 1. The environmental temperature is detected by an environment sensor THS (as in FIG. 1) installed within the printer.

TABLE 1

| Environmental Temperature | Estimated Power to be Used |
|---|---|
| 30° C. | 800 W |
| 20° C. | 850 W |
| 10° C. | 900 W |

Having described that, according to this embodiment, the estimated required power is determined on the basis of the environmental temperature only, the estimated required power may be determined in accordance with the temperature of the heater (or the fixing unit) upon start of printing, the type of recording material to be used, or printing rate information regarding an image to be printed, for example.

Next, the estimated required power (required power) Pfsr and the suppliable power Pf_lim are compared (S118). If the estimated required power Pfsr is lower than the suppliable power Pf_lim, printing is started at a highest speed (first speed) Vmax (mm/s) of the printer (S119). If the estimated required power Pfsr is higher than the suppliable power Pf_lim on the other hand, printing is started at a lower speed (second speed) Vdown (mm/s) than the highest speed (S120). Thus, the CPU (control unit) 32 starts image forming at a throughput (or an image forming speed in this embodiment) acquired by comparing the power to be used by the heater and the power suppliable to the heater when fix processing is performed.

Next, a speed return sequence after the start of image forming at the low speed Vdown (mm/s) will be described with reference to FIG. 4B. After the start of image forming, the electric-current detecting circuit 67 detects electric current Ip fed to the printer. An average value Ip_ave for one recording material is acquired where the sampling cycle of the electric current detection is once every several tens ms (S131). The average value Ip_ave of electric current may be an average value for a predetermined time period or a moving average value and is not limited to an average for one recording material.

On the basis of the calculated average value Ip_ave and the input voltage Vrms, power Pp being currently used by the printer is calculated by Expression (3) (S132).

$$Pp=Ip_\mathrm{ave}*Vrms \quad (3)$$

Next, power Pp_after estimated after the speed is returned to the highest speed Vmax (mm/s) is calculated by using a ratio among the power Pp, the highest speed Vmax (mm/s), and the current image forming speed Vdown (mm/s) as in Expression (4) (S133).

$$Pp_\mathrm{after}=Pp*V\,\mathrm{max}/V\mathrm{down} \quad (4)$$

A difference acquired by subtracting the estimated power Pp_after to be used by the printer when the speed is increased from the suppliable power Plimit corresponds to excess power when the speed is increased to Vmax (mm/s). If the excess power is equal to or higher than 0 (S134), the image forming speed is changed to Vmax (mm/s) (S135), and the continuous printing is kept (S136).

The CPU (control unit) 32, as described above, calculates the power Pp_after to be used by the printer when the image forming speed is increased, compares the power Pp_after to be used and the suppliable power Plimit for the printer, and thus determines whether the image forming speed is to be increased or not.

Figure 5:
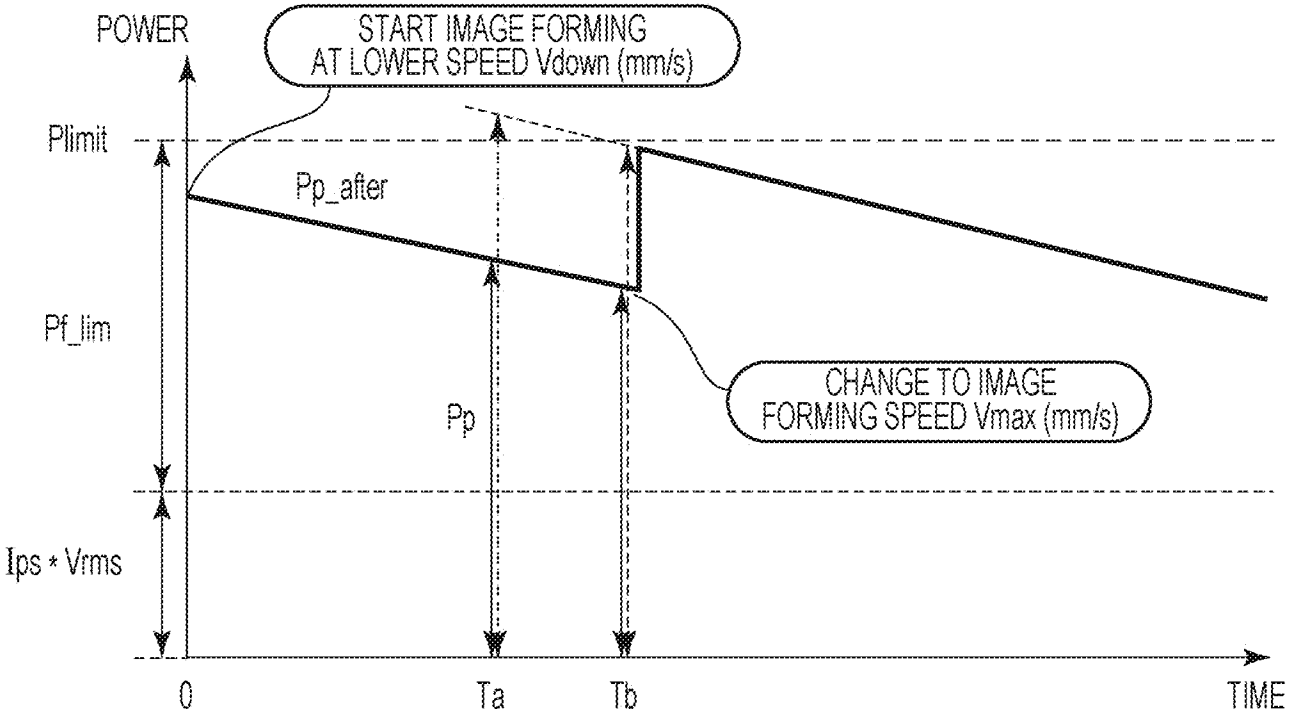
FIG. 5 is a time chart according to the first embodiment.

FIG. 5 is a time chart according to this embodiment. FIG. 5 has a horizontal axis indicating time and a vertical axis indicating power and illustrates changes in power consumption of the entire printer and switching timing for the image forming speed.

The timing at a time 0 corresponds to the timing for performing S120 in the flowchart where whether image forming at a low speed Vdown (mm/s) is to be started is judged. After that, the CPU 32 continues monitoring the power Pp at predetermined intervals. The power Pp_after after a speed change is calculated from the power Pp and is compared with the power Plimit.

Because the excess power acquired by Plimit−Pp_after is equal to or lower than 0 at a time Ta illustrated in FIG. 5, it is determined that the image forming speed is not to be changed to a higher speed. At a time Tb after a lapse of a certain time period when it is determined that the excess power is equal to or higher than 0, the CPU 32 changes the image forming speed to the speed Vmax (mm/s). At that time, though the power consumption of the entire printer has increased, the power consumption of the entire printer does not exceed the power Plimit. Therefore, the image forming is continued by keeping the speed Vmax (mm/s).

According to this embodiment, as described above, an image forming apparatus which executes a control for reducing its throughput when power is insufficient can secure possibly high productivity. Having described, according to this embodiment, the image forming speed can be changed between two speeds, an embodiment of the present disclosure is also applicable to a case where the speed may be increased in a stepwise manner in an apparatus supporting three or more levels of speed settings. Also in this case, the ratio of the speed before a switching operation and the speed after the switching operation may be used to calculate the power Pp_after after a speed change so that whether the speed is to be increased or not may be determined.

Second Embodiment

According to the first embodiment, an electric-current detecting circuit configured to detect electric current of an entire apparatus is provided on an upstream side (commercial power supply side) from a branch point DP between a feeding line from the commercial power supply 50 to the power supply 64 and a feeding line from the commercial power supply 50 to the phase control circuit 70. Then, whether the image forming speed can be returned is determined from the power to be used by the entire apparatus.

According to a second embodiment, an electric-current detecting circuit is provided for each of a feeding line closer to the power supply 64 than the branch point DP and a feeding line closer to the phase control circuit 70 than the branch point DP, and different calculations are performed for estimating power Pp_after after a speed change, for example. Because an image forming apparatus according to this embodiment has the same configuration as the one illustrated in FIG. 1, any repetitive description will be omitted.

Figure 6:
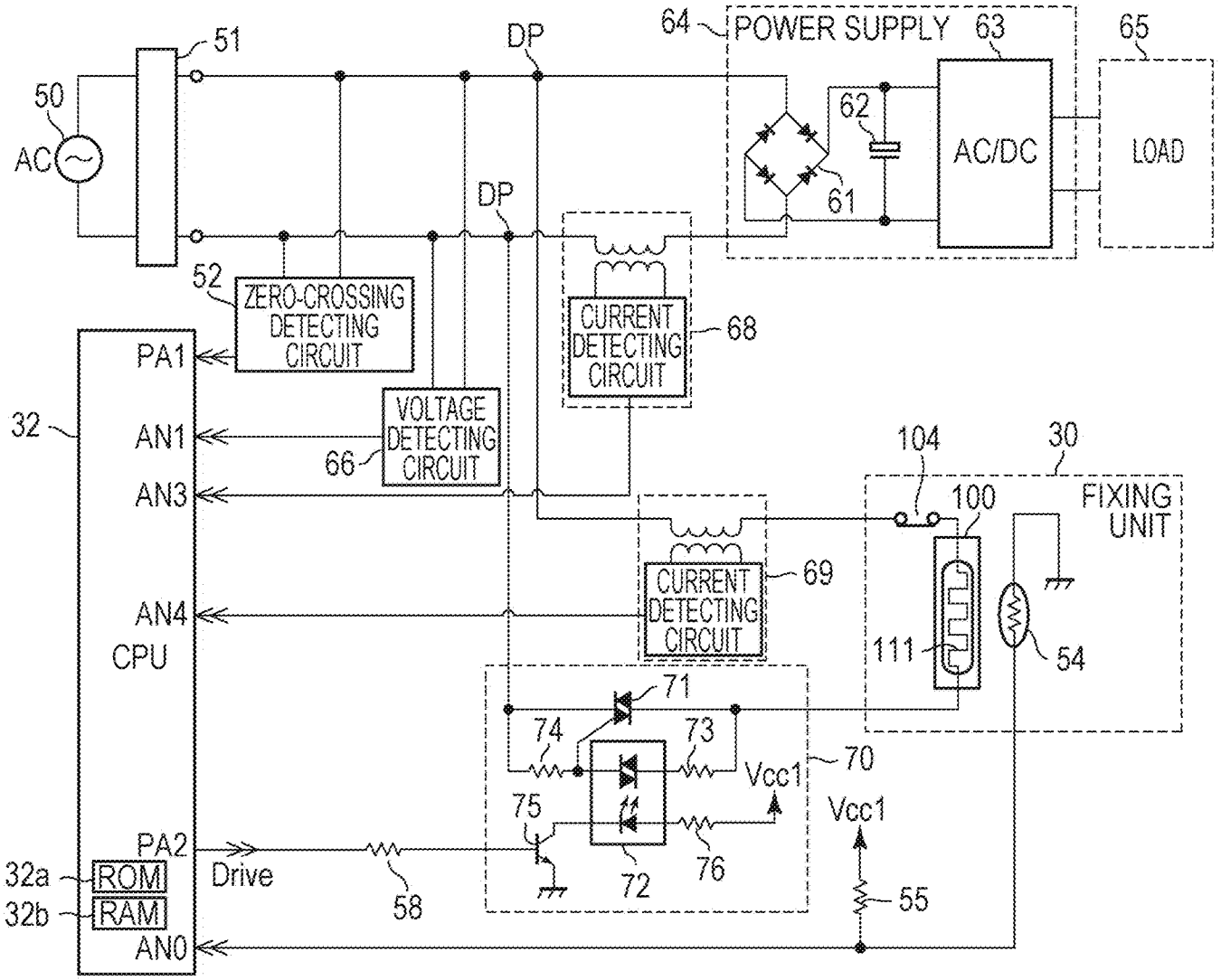
FIG. 6 is a circuit diagram, according to second and third embodiments.

FIG. 6 illustrates a heater driving circuit unit and a power supply according to the second embodiment. Differences from those illustrated in FIG. 3 will be described. In the circuit according to this embodiment, an electric-current detecting circuit (first electric-current detecting circuit) 68 is provided for a feeding line closer to the power supply 64 than the branch point DP, and an electric-current detecting circuit (second electric-current detecting circuit) 69 is provided for a feeding line closer to the phase control circuit 70 than the branch point DP. Signals output from the electric-current detecting circuits 68 and 69 are input to analog input ports AN3 and AN4 of the CPU 32 to detect values of electric current fed to the feeding lines.

From the detection results given by the voltage detecting circuit 66 and the electric-current detecting circuits 68 and 69, the CPU 32 can calculate a value of power consumed by the power supply 64 and a value of power consumed by the heater 100 independently.

The power estimated when the image forming speed is changed differs between a power supply load and the heater. In the power supply load, the amount of power increased by an increase of the image forming speed is mainly used by actuators which change their numbers of rotation and, more specifically, a motor 36 configured to drive rollers involved in conveyance of a recording material or a motor 35 configured to drive an intermediate transfer belt, for example. A load to be normally driven at an equal speed, such as a motor for driving a fan, does not change even when the image forming speed changes. Loads, for example, in a control system may hardly be influenced. Thus, the loads can be divided into a speed-dependent load influenced by a conveyance speed and a speed-independent load not influenced by a conveyance speed. In consideration of this, the power for a speed-dependent load may be determined, and the power after a speed change of the speed-dependent load may be calculated by using a speed ratio.

On the other hand, applications of power to be supplied to the heater may be divided into power to be used for fixing a toner image to a recording material and power to be used for heating an internal structure of the fixing unit, as in the first embodiment.

The power to be used for fixing a toner image to a recording material mainly changes when the image forming speed changes. The average power for fixing a toner image mainly depends on a throughput depending on both of the image forming speed and the conveyance intervals of recording materials. The throughput corresponds to at least one of the image forming speed and the conveyance intervals of recording materials. The power also depends on not only the conveyance speed but also the environmental temperature, the type of recording material, and printing rate information of an image to be printed. Thus, a throughput-dependent power section may be identified in the power to be supplied to the heater so that the power after a speed change of the throughput-dependent power section may be calculated by using a throughput ratio.

Figure 7:
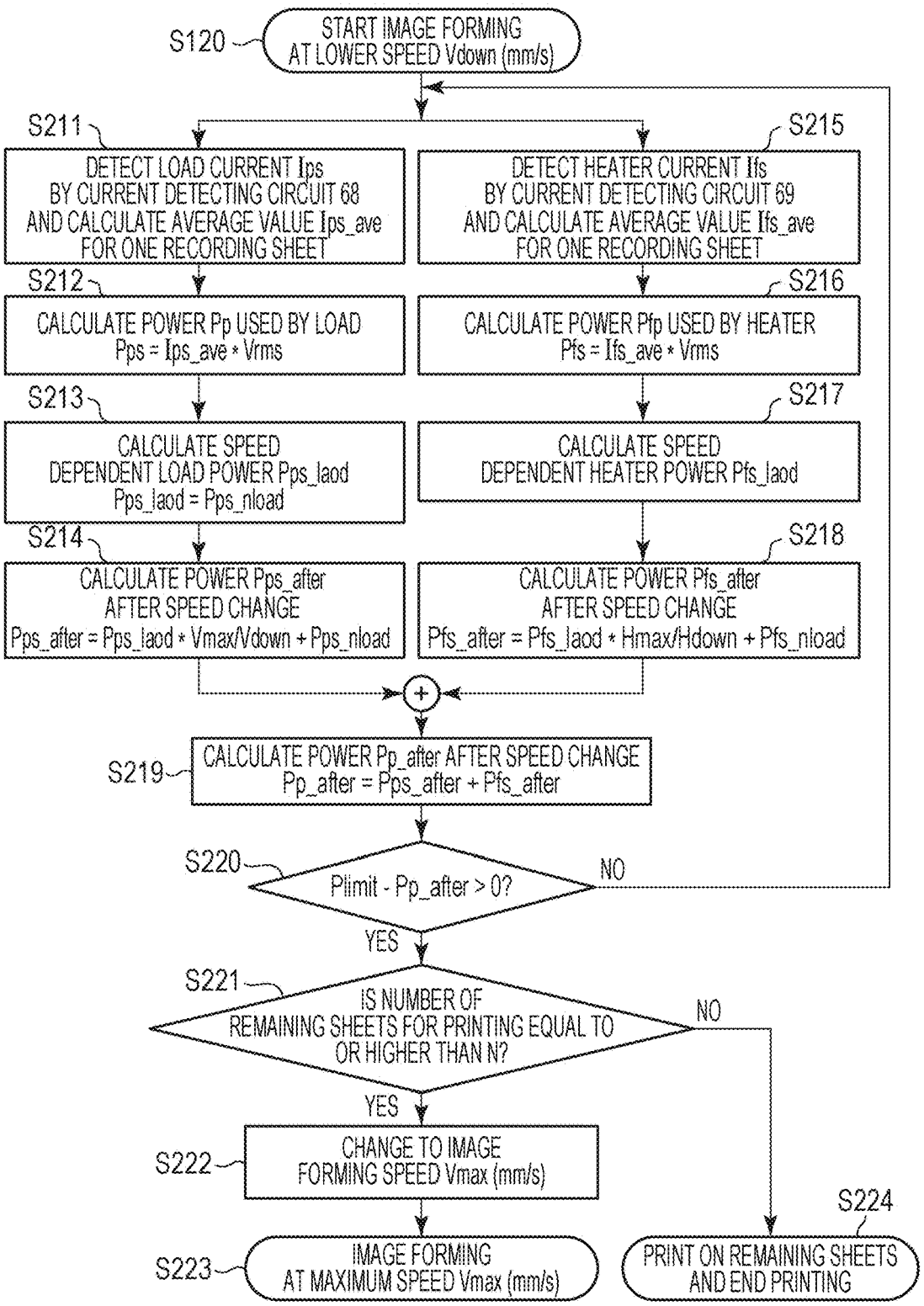
FIG. 7 is a flowchart according to the second embodiment.

A specific control will be described below with reference to a flowchart in FIG. 7. FIG. 7 illustrates a return sequence after image forming is started at a low speed Vdown (mm/s) (S120). According to this embodiment, Vmax (mm/s) is a maximum image forming speed set in the image forming apparatus, and Vdown (mm/s) is an image forming speed selected due to power control, as in the first embodiment. Hmax (ppm) in the flowchart is a throughput produced with conveyance at Vmax (mm/s), and Hdown (ppm) is a throughput produced with conveyance at Vdown (mm/s).

The determination of the image-forming starting speed may be performed by the same flow as that in the first embodiment. In the configuration according to this embodiment, the image-forming starting speed is determined from the power Pps used by a power supply load, which is detected by the electric-current detecting circuit 68.

After image forming is started at a speed Vdown (mm/s) (S120), the electric-current detecting circuits 68 and 69 detect detection results Ips and Ifs in parallel. These detections are performed in a sampling cycle of once per several 10 ms, and average values Ips_ave and Ifs_ave for one recording material are calculated (S211, S215). After that, the power Pps to be used by the power supply load and the power Pfs used by the heater are calculated as in Expressions (5) and (6) (S212, S216).

$$Pps = Ips_\mathrm{ave} * Vrms \tag{5}$$

$$Pfp = Ifp_\mathrm{ave} * Vrms \tag{6}$$

Next, a speed-dependent power Pps_load of the power Pps used by the power supply load is calculated as in Expression (7) (S213).

$$Pps_\mathrm{load} = Pps - Pps_n\mathrm{load} \tag{7}$$

Here, Pps_nload is power dependent on a speed which is a result of a measurement of power for driving a power supply load independent from a speed of a fan motor, for example, in a state that the conveying motor 36 or the process motor 35 is not driven. This control is performed when, for example, the printer is powered on before a print job is input and is prestored in the RAM 32*b*. Pps_nload may be prestored in the RAM 32*b* as a designed value (fixed value).

Next, estimated power Pps_after after a speed change of the power supply load caused when the image forming speed Vmax (mm/s) is returned from the speed Vdown (mm/s) to the maximum speed is calculated by the following Expression (8) (S214).

$$Pps_\mathrm{after} = Pps_\mathrm{load} * V\,\mathrm{max}/V\mathrm{down} + Pps_n\mathrm{load} \tag{8}$$

This expression shows that the speed-dependent power Pps_load only increases as the speed increases.

On the other hand, power Pfs_load dependent on a throughput of the power Pfs used by the heater is calculated (S217). The throughput-dependent power Pfs_load is power to be mainly used for fixing a toner image onto a recording material and has a value dependent on an ambient environmental temperature or the type of recording material. Table 2 shows a relationship among power Pfs_load, environmental temperatures, and types of recording material and is stored in the ROM 32*a*. Table 2 shows power used for feeding a recording material at a throughput Hdown (ppm) and printing an image at a maximum printing rate.

TABLE 2

| Types of Recording Material<br>Environmental Temperature | Thin Paper | Normal Paper | Thick Paper |
|---|---|---|---|
| 30° C. | 400 W | 450 W | 500 W |
| 20° C. | 450 W | 500 W | 550 W |
| 10° C. | 500 W | 550 W | 600 W |

Pfs_load determined on the basis of the ambient environmental temperature and the type of recording material is used to calculate an estimated power Pfs_after after a speed change of the heater when the image forming speed is returned to a higher speed by using the following Expression (9) (S218).

$$Pfs_\mathrm{after} = Pfs_\mathrm{load} * H\,\mathrm{max}/H\mathrm{down} + Pfs_\mathrm{nload} \tag{9}$$

This expression shows that the speed-dependent power Pps_load only increases as the speed increases.

After that, estimated power Pp_after after a speed change of the entire apparatus when the image forming speed is returned to a higher speed is calculated by using the following Expression (10) (S219)

$$Pp_\mathrm{after} = Pps_\mathrm{after} + Pfs_\mathrm{after} \tag{10}$$

The difference acquired by subtracting the power Pp_after after a speed change from the power Plimit corresponds to excess power when the image forming speed is returned. If the excess power is equal to or lower than 0 (S220), it may be determined that power is still insufficient. Then, the image forming continues at Vdown (mm/s).

On the other hand, if the excess power is equal to or higher than 0 (S220), it may be determined that a change to a higher speed is possible. If the number of remaining sheets subject to the current print job is equal to or higher than a predetermined number N (S221), a speed change is caused. The image forming speed is changed to Vmax (mm/s) (S222), and the continuous printing is kept (S223). However, the number of remaining sheets subject to the print job is lower than the predetermined number N (S221), the image forming speed is not changed but the low speed Vdown (mm/s) is kept to complete the rest of the printing (S224).

The control specifications is provided in consideration of the fact that, because a predetermined time may be used for changing the image forming speed, when the number of remaining sheets is equal to two or three, printing can be completed more quickly without changing the speed. In a case where the remaining number of sheets is not available under control of the controller, the image forming speed may be changed to a higher speed irrespective of the remaining number of sheets.

According to this embodiment, as described above, an image forming apparatus may be provided in which a control for reducing its throughput is executed in a case where power is sufficient while securing possibly high productivity. In particular, the power to be used in the apparatus when its operating speed is increased to a maximum throughput may be estimated on the basis of the speed-dependent power sections for a power supply side load and a heater load so that timing for changing the speed may be set more accurately.

Third Embodiment

A third embodiment relates to an apparatus which, in a case where it is initially determined that power is insufficient, increases the conveyance intervals and image forming intervals for recording materials to reduce power to be used, without changing an image forming speed thereof. Increasing the conveyance intervals may reduce the amount of power to be used less than changing the image forming speed. However, higher usability may be produced in that the time for changing the speed is not necessary during a continuous printing operation.

Because an image forming apparatus according to this embodiment has the same configuration as the configuration illustrated in FIG. 1, any repetitive descriptions will be omitted. The image forming apparatus has the same circuit configuration as that of the circuit in FIG. 5 according to the second embodiment.

Figure 8:
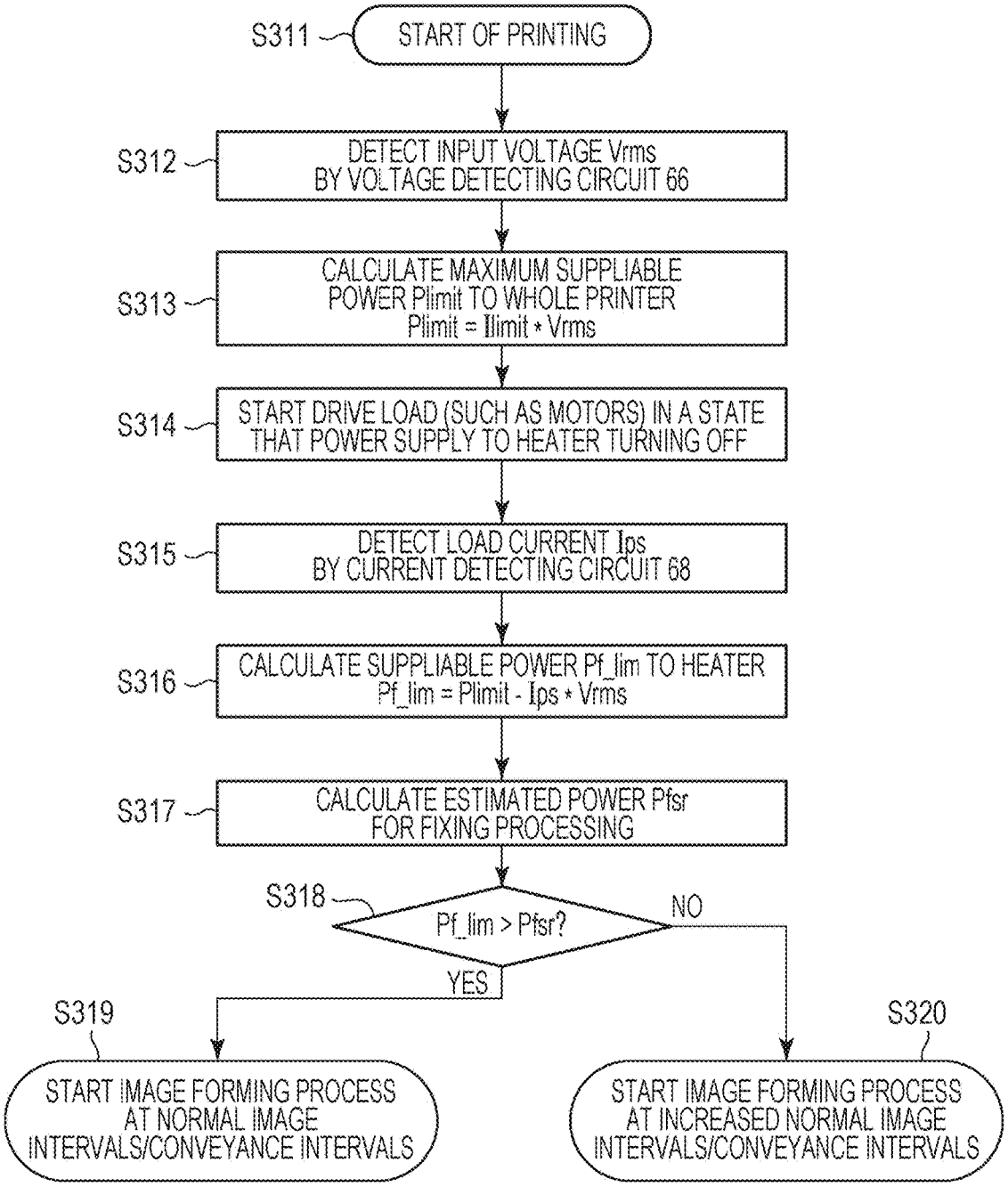
FIG. 8 is a flowchart according to the third embodiment.
Figure 9:
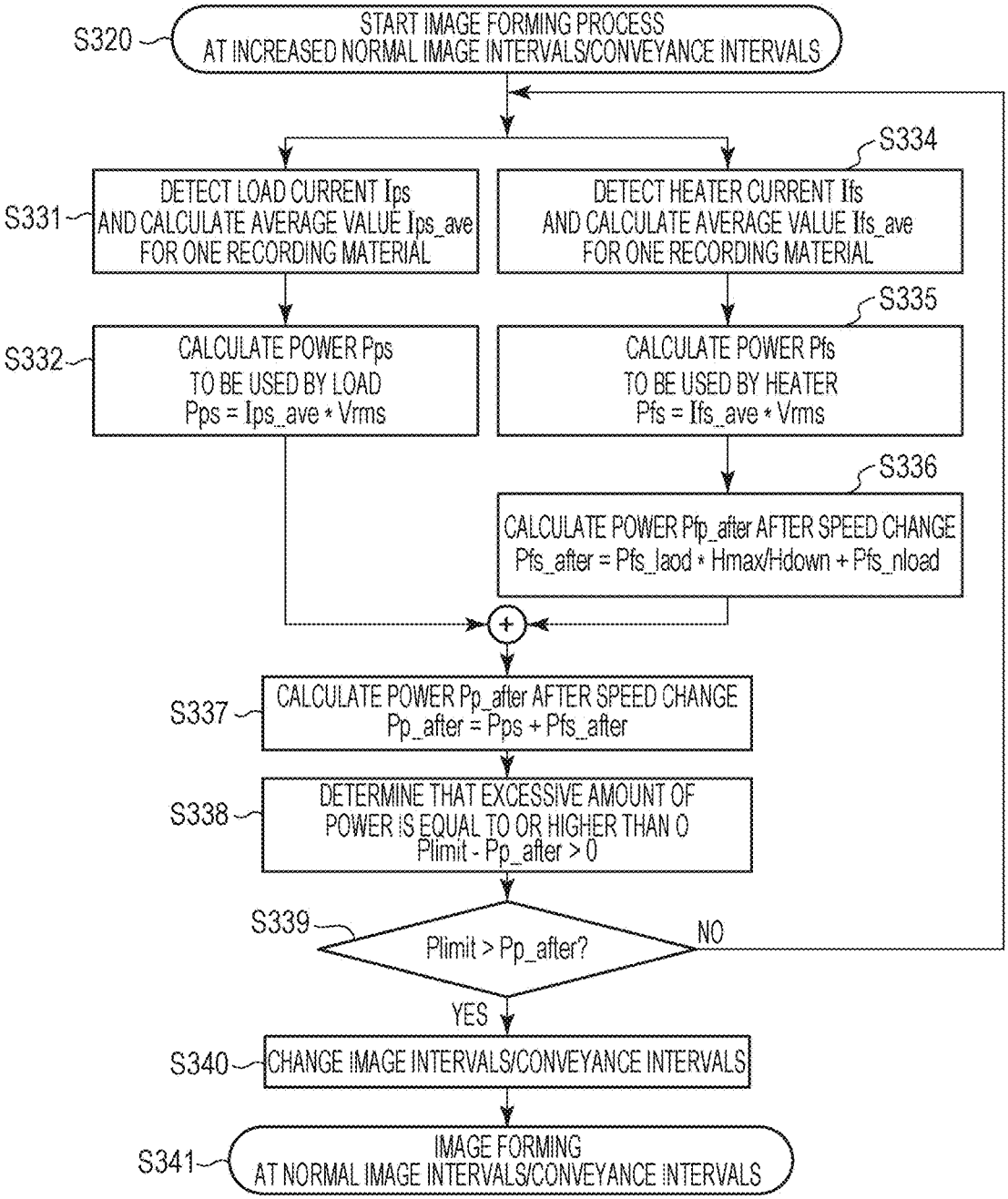
FIG. 9 is a flowchart according to the third embodiment.

Control according to this embodiment will be described with reference to a flowchart in FIG. 8. FIG. 8 illustrates a flow for selecting a low power mode under power control, like the flow in FIG. 4A and is different from FIG. 4A in that the image intervals/conveyance intervals are changed in S319 and S320 instead of the conveyance speed. Referring to FIG. 9, the operations up to calculation of a power Pps to be used by a load and a power Pfs to be used by a heater (S331 to S335) are the same as those of the second embodiment.

According to this embodiment, the conveyance intervals for recording materials are increased, instead of changing the image forming speed, to reduce a throughput thereof. Thus, the power supply load does not change for changing to a maximum throughput. Therefore, the power Pfs_after after a speed change is calculated only from the heater power during an image forming operation by using the following Expression (11) (S336).

$$Pfs_\text{after}=Pfs_\text{load}*H\ \text{max}/H\text{down}+Pfs_n\text{load} \quad (11)$$

where Hmax (ppm) is a throughput with reduced conveyance intervals, and Hdown (ppm) is a throughput with increased conveyance intervals.

After that, estimated power Pp-after after a speed change of the entire apparatus when the conveyance intervals are reduced to return to a maximum throughput is calculated by using the power Pps to be used by a load and the power Pfs_after after a change in speed of the heater as in Expression (12) (S337).

$$Pp_\text{after}=Pps+Pfs_\text{after} \quad (12)$$

The difference acquired by subtracting power Pp_after after a speed change from suppliable power Plimit corresponds to excess power when the image forming speed is returned. If the excess power is equal to or lower than 0, it may be determined that power is still insufficient. Then, the image forming is continued at the increased conveyance intervals and increased image forming intervals, and the flow for calculating an average used power for one recording material is continuously executed.

On the other hand, if the excess power is equal to or higher than 0, the conveyance intervals are reduced to return to the maximum throughput.

Also according to this embodiment, as described above, the image forming apparatus can secure possibly high productivity.

As understood from the first to third embodiments, the CPU (control unit) 32 may calculate power to be used in the apparatus in a case where its throughput is increased and compares the power to be used and the suppliable power to the apparatus are compared to determine whether the throughput is to be increased or not.

Embodiments of the present disclosure can provide an image forming apparatus realizing possibly high productivity by executing the control for reducing its throughput when power is insufficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-091443 filed Apr. 28, 2016, which is hereby incorporated by reference herein in its entirety.

What is claimed is:

1. An image forming apparatus comprising:

an image forming unit configured to form an image on a recording material;

a fixing unit having a heater and configured to heat and fix an image formed on the recording material onto the recording material; and a control unit, wherein the control unit calculates estimated power (Pp_after) to be used in the apparatus in a case where a throughput thereof is to be increased to become higher than a current throughput during forming the image, and compares the estimated power (Pp_after) and maximum suppliable power (Plimit) to the apparatus to determine whether the throughput is to be increased or not, and wherein if the power used by the apparatus during forming the image at the current throughput is defined as power (Pp), the power (Pp_after) is calculated on a basis of the power (Pp) and a ratio of the current throughput to a throughput after the change.

2. The image forming apparatus according to claim 1, wherein the control unit increases the throughput in a case where the estimated power is less than the maximum suppliable power.

3. The image forming apparatus according to claim 1, wherein the throughput is at least one of an image forming speed and a recording material conveyance interval.

4. The image forming apparatus according to claim 1, wherein the control unit causes image forming to be started at a throughput determined by comparing power used by the heater for performing fixing processing and suppliable power to the heater.

5. The image forming apparatus according to claim 1, further comprising a voltage detecting circuit configured to detect voltage of a commercial power supply and an electric-current detecting circuit configured to detect electric current flowing in the entire apparatus, and wherein the control unit calculates power to be used by the entire apparatus on the basis of an output from the voltage detecting circuit and an output from the electric-current detecting circuit.

6. The image forming apparatus according to claim 1, further comprising a voltage detecting circuit configured to detect voltage of a commercial power supply, a power supply, a first electric-current detecting circuit configured to detect electric current fed to the power supply and a second electric-current detecting circuit configured to detect electric current fed to the heater, wherein the control unit calculates power to be consumed by the power supply and power to be consumed by the heater on the basis of an output from the voltage detecting circuit, an output from the first electric-current detecting circuit, and an output from the second electric-current detecting circuit, and wherein the control unit calculates the power to be used in the apparatus based on a sum of the power to be consumed by the power supply and the power to be consumed by the heater.

7. The image forming apparatus according to claim 1, wherein, regardless of the result of comparison of the estimated power and the maximum suppliable power, the control unit does not change the throughput in a case where the number of remaining sheets for printing is less than a predetermined number of sheets.

8. The image forming apparatus according to claim 1, wherein the fixing unit has a tubular film, and wherein the heater is in contact with an inner surface of the tubular film.

9. The image forming apparatus according to claim 8, wherein the fixing unit has a pressure roller configured to form a fixing nip for pinching and conveying the recording material in cooperation with the heater through the tubular film, and wherein the image formed on the recording material is fixed onto the recording material at the fixing nip.

10. A method for determining a throughput when an image is formed on a recording material, comprising:

calculating maximum suppliable power (Plimit) to an image forming apparatus;

calculating estimated power to be used by the apparatus (Pp_after) after increasing the throughput from the current throughput during forming the image;

comparing the maximum suppliable power (Plimit) with the power (Pp_after) to determine whether to continue forming the image at the current throughput or continue forming the image with a throughput higher than the current throughput, wherein if the power used by the apparatus during forming the image at the current throughput is defined as power (Pp), the power (Pp_after) is calculated on a basis of the power (Pp) and a ratio of the current throughput to a throughput after the change.

11. The method according to claim 10, wherein the image forming apparatus comprises a heater configured to fix the image onto the recording material, and wherein determining the throughput at time of starting forming the image by comparing power (Pf_lim) suppliable to the heater with estimated required power (Pfsr) that is to be required when fixing processing is performed.

12. The method according to claim 10, wherein the throughput is at least one of an image forming speed and a recording material conveyance interval.

* * * * *